United States Patent [19]

Katoh

[11] Patent Number: 4,601,599

[45] Date of Patent: Jul. 22, 1986

[54] BALL-POINT PEN

[75] Inventor: Hiroyasu Katoh, Takasaki, Japan

[73] Assignee: Katoh Kinzoku Kogyo Kabushiki Kaisha, Tomioka, Japan

[21] Appl. No.: 650,410

[22] Filed: Sep. 13, 1984

[30] Foreign Application Priority Data

Dec. 27, 1983 [JP] Japan ..... 58-248952
Mar. 23, 1984 [JP] Japan ..... 59-55340

[51] Int. Cl.[4] ..... B43K 5/16; B43K 7/12; B43K 24/02

[52] U.S. Cl. ..... 401/99; 401/91; 401/100; 401/109; 401/117

[58] Field of Search ..... 401/99, 100, 117, 91, 401/65, 109

[56] References Cited

U.S. PATENT DOCUMENTS

| | | | |
|---|---|---|---|
| 1,970,399 | 8/1934 | Shatkin | 401/95 |
| 2,034,133 | 1/1935 | Dredge | 401/117 |
| 2,206,681 | 7/1940 | Sztranszky | 401/117 |
| 2,500,979 | 3/1950 | Coler-Dark | 401/117 |
| 2,941,511 | 6/1960 | Cieremans | 401/117 |
| 4,315,695 | 2/1982 | Santos et al. | 401/99 |

FOREIGN PATENT DOCUMENTS

| | | | |
|---|---|---|---|
| 1692368 | 12/1954 | Fed. Rep. of Germany | 401/99 |
| 812516 | 4/1959 | Fed. Rep. of Germany | 401/91 |
| 1981195 | 11/1967 | Fed. Rep. of Germany | 401/99 |
| 1761731 | 6/1968 | Fed. Rep. of Germany | 401/100 |
| 1146845 | 11/1957 | France | 401/100 |
| 453282 | 11/1949 | Italy | 401/117 |
| 253272 | 2/1948 | Switzerland | 401/117 |
| 378189 | 5/1964 | Switzerland | 401/117 |
| 366682 | 2/1932 | United Kingdom | 401/100 |
| 1288909 | 9/1972 | United Kingdom | 401/99 |

*Primary Examiner*—Richard J. Apley
*Assistant Examiner*—Alfedo Acoff
*Attorney, Agent, or Firm*—Frishauf, Holtz, Goodman & Woodward

[57] ABSTRACT

A ball-point pen has an elongate telescopic body which includes a front holder portion and a rear holder portion fitted on the front holder portion to be movable between a compressed position and a stretched position. A ball-point pen refill is disposed in the front holder portion and has a refill tip protruding from one end of the front holder portion. A concealing sleeve is disposed in one end of the front holder portion to be slidable along the ball-point pen refill. When the rear holder portion is moved to the compressed position, the sleeve is moved to conceal the refill tip, and when the rear holder portion is moved to the stretched position, the sleeve is moved to expose the refill tip. When the rear holder portion is moved to the compressed position, the rear holder portion is held in the position by a holding mechanism.

13 Claims, 6 Drawing Figures

BALL-POINT PEN

BACKGROUND OF THE INVENTION

The present invention relates to a ball-point pen, and more specifically to a telescopic ball-point pen.

Some conventional ball-point pens comprise an elongate body containing a ball-point pen refill and a removable cap attached to the front end portion of the body to cover the pen point, while others are of the so-called push-button type. In the ball-point pens of the former category, the cap is troublesome to handle and liable to be lost. Further, the ball-point pen body is relatively long, and is not convenient for carrying in a pocket of clothes or the like.

Like the ball-point pens of the first type, the ball-point pens of the push-buttom type are relatively long, and are not handy to carry. When one such ball-point pen is carried in a pocket, moreover, its buttom may unexpetedly be pushed to project the pen point, possibly staining the pocket with ink.

SUMMARY OF THE INVENTION

The present invention is contrived in consideration of these circumstances, and is intended to provide a ball-point pen capable of being easily stored in a pocket or the like when not in actual use, and of being readily adjusted to a stand-by position for writing without the possibility of unexpected projection of the pen point.

In order to achieve the above object, a ball-point pen according to the present invention is provided with a telescopic body containing a ball-point pen refill therein, and is constructed so that the pen point is hidden when the body is contracted and that the pen point is exposed for writing when the body is extended. The ball-point pen is further provided with retaining means for holding the body in the contracter state.

When not in actual use, the ball-point pen constructed in this manner can easily be stored in a pocket or the like if it is made shorter than prior art ones by contracting the body. Since the body can securely be held in the contracted state by the retaining means, the pen is prevented from being unexpectedly exposed. In actual use, the pen point can be exposed by only extending the body. In the extended state, the body is as long as those of the prior art ball-point pens, that is, long enough to maintain the handling performance.

DETAILED DESCRIPTION OF THE PREFERRED EMBODIMENTS

Preferred embodiments of the present invention will now be described in detail with reference to the accompanying drawings.

Figure 1:
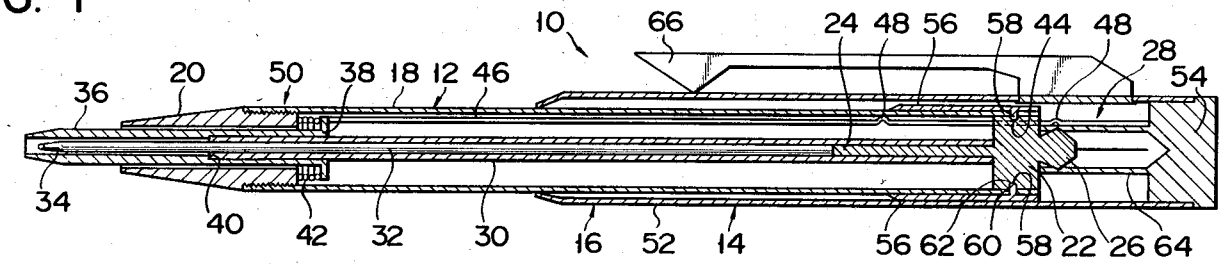
FIGS. 1 and 2 are longitudinal sectional views showing a contracted state and an extended state, respectively, of a ball-point pen according to a first embodiment of the present invention.
Figure 2:
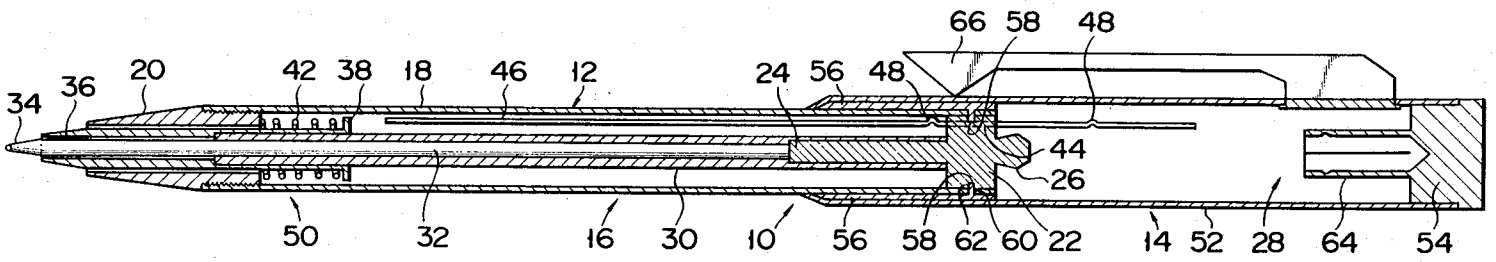

FIGS. 1 and 2 show a ball-point pen 10 according to a first embodiment of the present invention. The ball-point pen 10 is provided with an elongate telescopic body 16 which includes a front holder portion 12 and a rear holder portion 14 slidably fitted on the front holder portion 12.

The front holder portion 12 includes a cylindrical front holder body 18, a substantially cylindrical mouthpiece 20 screwed in the front end of the front holder body 18, and an end plate 22 closing the rear end of the front holder body 18. The end plate 22 has a columnar supporting projection 24 protruding toward the mouthpiece 20 and an engaging projection 26 protruding in the opposite direction to the supporting projection 24. The engaging projection 26 constitutes part of retaining means 28 (mentioned later).

A cylindrical refill casing 30 coaxially extends in the front holder body 18. One end portion of the refill casing 30 extends into the bore of the mouthpiece 20, while the other end is fitted on the supporting projection 24. A ball-point pen refill 32 is removably inserted in the refill casing 30. A refill tip 34 of the ball-point pen refill 32 projects to the outside, penetrating the bore of the mouthpiece 20.

A concealing sleeve 36 is slidably fitted in the bore of the mouthpiece 20, and the refill tip 34 of the ball-point pen refill 32 and the front end portion of the refill casing 30 are inserted in the sleeve 36. The concealing sleeve 36 has a flange 38 extending outward from its rear end and a stepped portion 40 formed in the substantially central portion of its inner peripheral surface. The sleeve 36 is adapted to move between a concealing position to conceal the refill tip 34, as shown in FIG. 1, and a retracted position to expose the refill tip 34, as shown in FIG. 2. The retracted position is defined when the stepped portion 40 of the sleeve 36 abuts against the front end of the refill casing 30. A compression spring 42 is interposed between the mouthpiece 20 and the flange 38 of the sleeve 36, whereby the sleeve 36 is urged toward the retracted position.

A through hole 44 is bored through the end plate 22, extending along the axial direction of the front holder body 18. An elongate push rod 46 is passed through the through hole 44 for longitudinal reciprocation. The push rod 46 extends in either direction from the end plate 22. The front end of the push rod 46 can engage the flange 38 of the concealing sleeve 36. The push rod 46 is formed with bumps 48 located on either side of the through hole 44. The bumps 48 prevent the push rod 46 from slipping out of the through hole 44 at the time of assembly. When forced in toward the mouthpiece 20, the push rod 46 pushes the concealing sleeve 36 to its concealing position to conceal the refill tip 34 of the ball-point pen refill 32. The push rod 46, along with the concealing sleeve 36 and the spring 42, constitutes concealing means 50 of the present invention.

On the other hand, the rear holder portion 14 includes a cylindrical rear holder body 52 slidably fitted on the outer periphery of the rear end portion of the front holder body 18, and a rear end plate 54 closing the rear end of the rear holder body 52 and facing the end plate 22 of the front holder portion 12. The rear holder body 52 is adapted to move along the outer periphery of the front holder body 18 between a compressed position shown in FIG. 1 and a stretched position shown in FIG. 2, thereby causing the ball-point pen body 16 to contract and extend. A pair of arcuate stoppers 56 each formed of a leaf spring are attached to the outer peripheral surface of the rear end portion of the front holder body 18, interposed between the front and rear holder bodies 18 and 52. Each stopper 56 has an inward projection 58, which is fitted in each corresponding one of recesses 62 in the end plate 22, passing through each corresponding hole 60 in the front holder body 12. The stoppers 56 are elastically in contact with the inner peripheral surface of the rear holder body 52, thereby holding the rear holder body 52 in any position between the compressed and stretched positions. The front end edge of the rear holder body 52 is bent inward so that it engages the stoppers 56 to prevent the rear holder body 52 from coming off the front holder body 18.

The rear end plate 54 is provided with an engaging portion 64 which protrudes toward the end plate 22. The engaging portion 64 engages the engaging projection 26 of the end plate 22 to hold the rear holder body 52 in its compressed position when the rear holder body 52 is moved to the compressed position. The rear end of the push rod 46, which is adapted to abut against the rear end plate 54, is pushed forward by the rear end plate 54 when the rear holder body 52 is moved to the compressed position.

The distance between the mouthpiece 20 and the flange 38 of the concealing sleeve 36, the respective lengths of the push rod 46 and the ball-point pen refill 32, and the distance between the engaging projection 26 and the engaging portion 64 are determined correlatively.

In FIGS. 1 and 2, numeral 66 designates a clip which is fixed to the outer surface of the rear holder body 52.

In using the ball-point pen 10 constructed in this manner, the rear holder body 52 is pulled backward from the contracted position of FIG. 1 to disengage the engaging portion 64 from the engaging projection 26. If the rear holder body 52 is further pulled backward, the concealing sleeve 36 is released from the push by the push rod 46 and is moved to its retracted position by the urging force of the spring 42. As a result, the refill tip 34 of the ball-point pen refill 32 is exposed to be ready for writing. If the rear holder body 52 is pulled to its action limit or the stretched position, the ball-point pen 10 assumes the extended state as shown in FIG. 2. In this state, the two ends of the push rod 46 are separated individually from the rear end plate 54 and the concealing sleeve 36. The extended length of the ball-point pen body 16 may be set freely according to a user's preference by adjusting the stretch of the rear holder body 52.

When the ball-point pen 10 is not being actually used or is to be stored in a pocket, the rear holder body 52 is moved from the stretched position of FIG. 2 to the compressed position of FIG. 1. In the course of the movement of the rear holder body 52, the rear end plate 54 engages the rear end of the push rod 46 to move the push rod 46 forward. As a result, the push rod 46 pushes the flange 38 of the concealing sleeve 36 against the urging force of the spring 42, thereby moving the concealing sleeve 36 to the concealing position. Thus, the refill tip 34 of the ball-point pen refill 32 is concealed by the sleeve 36. When the rear holder body 52 is pushed to its compressed position, the engaging portion 64 engages the engaging projection 26. Thus, the rear holder body 52 is held in the compressed position, and the ball-point pen 10 is brought to the contracted state shown in FIG. 1. In the contracted state, the two ends of the push rod 46 are in engagement with the flange 38 of the concealing sleeve 36 and the rear end plate 54 of the rear holder body 52, individually, so that the concealing sleeve 36 is prevented from being drawn into the retracted position by the spring 42.

According to the ball-point pen 10 of this embodiment, as described above, the refill tip 34 of the ball-point pen refill 32 can easily be concealed or exposed by simply pushing or pulling the rear holder body 52 relative to the front holder body 18. Thus, the ball-point pen 10 can be handled smoothly in writing or for storage. In the contracted state, moreover, the ball-point pen body 16 is shorter than the bodies of prior art ball-point pens. Therefore, the ball-point pen 10 can easily be stored in a shallow pocket of a shirt, allowing its clip 66 to fully clasp the hem of the pocket. In the contracted state, furthermore, the refill tip 34 of the ball-point pen refill 32 is prevented from being unexpectedly exposed to soil the pocket. In the extended state, on the other hand, the ball-point pen body 16 is as long as the bodies of the prior art ball-point pens, maintaining its handling performance.

It is to be understood that the present invention is not limited to the embodiment described above, and that various changes are modifications may be effected therein by one skilled in the art without departing from the scope or spirit of the invention.

Figure 3:
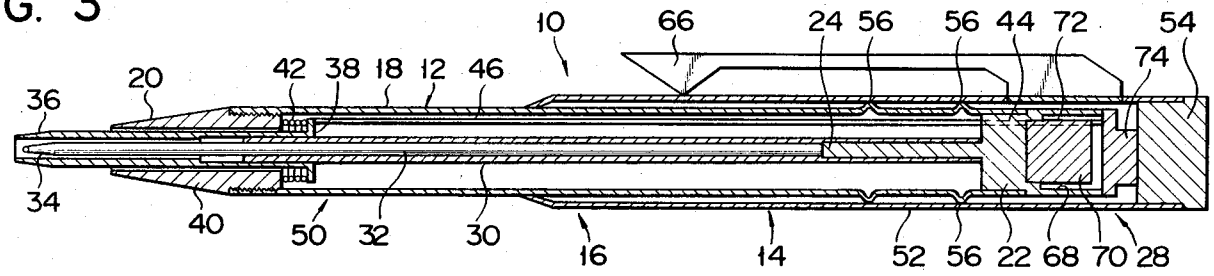
FIGS. 3 and 4 are longitudinal sectional views showing a contracted state and an extended state, respectively, of a ball-point pen according to a second embodiment of the invention.
Figure 4:
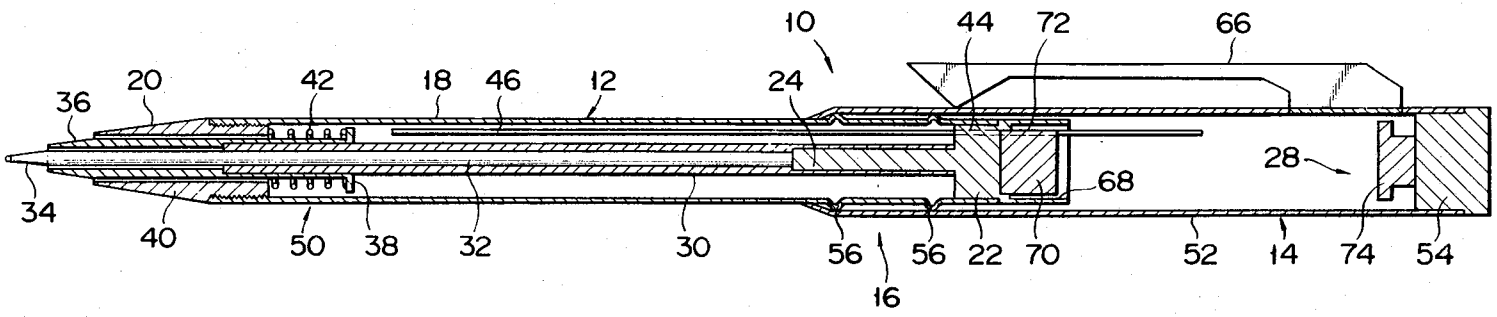

For example, the front and rear holder bodies are not limited to the cylindrical configuration, and may also have elliptic or polygonal cross sections. In the above embodiment, the retaining means 28 is described as a combination of the engaging projection 26 and the engaging portion 64. Alternatively, however, it may be formed of a recess in the end plate 22 and a projection protruding from the rear end plate 54. As shown in FIGS. 3 and 4, moreover, a magnet may be used for the retaining means.

According to a second embodiment shown in FIGS. 3 and 4, a backwardly opening cavity 68 is formed in the end plate 22 of the front holder body 18, and a magnet 70 is contained in the cavity 68. The magnet 70 is disposed so as to be spaced from the inner peripheral surface of the cavity 68 and not to project from the end plate 22. The magnet 70 is formed with a groove 72 through which the push rod 46 is passed. (The groove 72 may be omitted depending on the size of the magnet 70.) An attraction member 74 formed of a magnetic material is fixed to the rear end plate 54 of the rear holder body 52, projecting toward the end plate 22. If the rear holder body 52 is pushed to its compressed position, the attraction member 74 is attracted to the rear end of the end plate 22, as shown in FIG. 3, thereby holding the rear holder body 52 in the compressed position.

In this second embodiment, moreover, a pair of ring-shaped projections protruding from the outer peripheral surface of the rear end portion of the front holder body 18 are used as the stoppers 56, instead of using the leaf springs. The push rod 46 is preferably formed of a nonmagnetic material.

The second embodiment may provide the same effect as the first embodiment. In FIGS. 3 and 4, like reference numerals refer to like members shown in FIGS. 1 and 2, and a description of those members is omitted.

Figure 5:
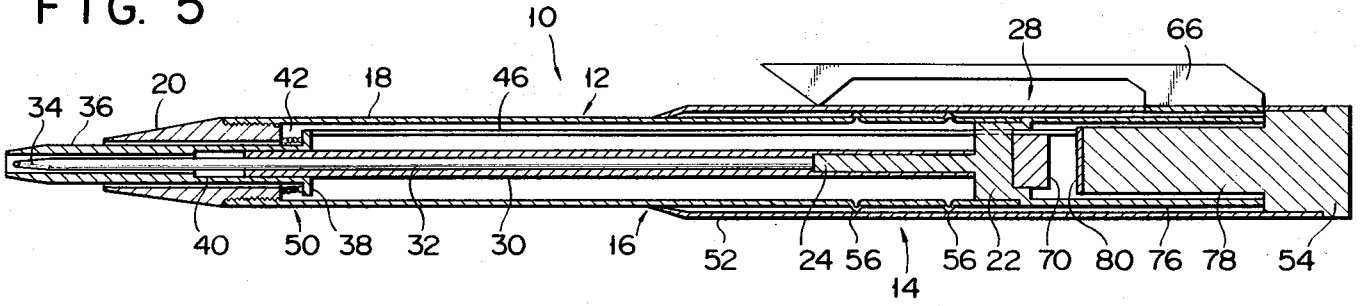
FIGS. 5 and 6 are longitudinal sectional views showing a contracted state and an extended state, respectively, of a ball-point pen according to a third embodiment of the invention.
Figure 6:
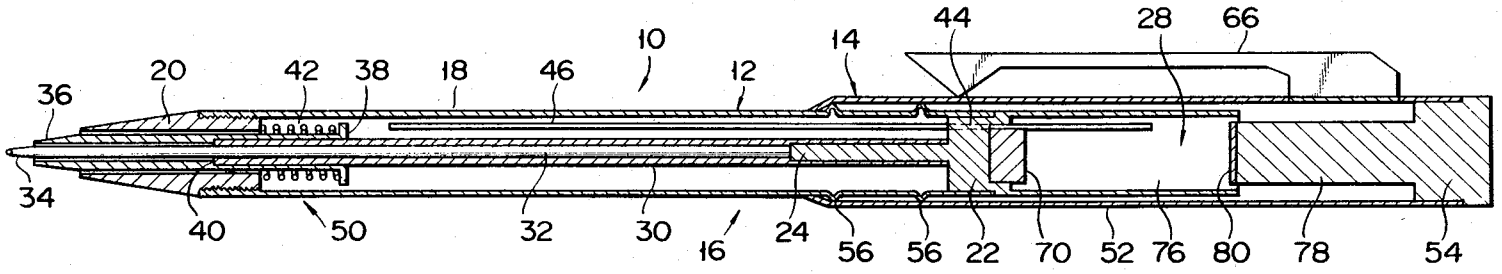

FIGS. 5 and 6 show a third embodiment of the invention. According to this embodiment, the end plate 22 has a cylindrical portion 76 which extends backward so as to be coaxial with the front holder body 18. The extended end of the cylindrical portion 76 is located substantially halfway between the two ends of the rear holder body 52 when the ball-point pen body 16 is in the extended state. The magnet 70 is fixed to the bottom of the cylindrical portion 76. The cylindrical portion 76 is formed of a magnetic material.

The rear end plate 54 has a columnar insert member 78 which protrudes toward the end plate 22. The insert member 78 extends substantially to the central portion of the rear holder body 52. An attraction plate 80 formed of a magnetic material is fixed to the extended end of the insert member 78.

If the rear holder body 52 is pushed to its compressed position, the insert member 78 is inserted into the cylindrical portion 76, and the attraction plate 80 is attracted to the magnet 70.

According to this third embodiment, part of the insert member 78 is always held in the cylindrical portion 76 without regard to the position or state of the ball-point pen 10. Thus, the strength of the whole structure of the ball-point pen 10 is increased. It is to be understood that the third embodiment can provide the same effect as the first embodiment.

What is claimed is:

1. A ball-point pen, comprising:

an elongate telescopic body including a front holder portion, and a rear holder portion fitted on the front holder portion to be movable axially between a compressed position and a stretched position relative to said front holder portion;

a ball-point pen refill disposed in the front holder portion and having a refill tip protruding from an opening at one end of the front holder portion remote from said rear holder portion;

concealing means a part of which movably extends from the opening at said one end of said front holder portion for concealing the refill tip of the ball-point pen refill when the rear holder portion is moved to the compressed position, and for exposing the refill tip when the rear holder portion is moved to the stretched position, said concealing means including means for biasing the extending part thereof toward a retracted position to expose the refill tip when the rear holder portion is at said stretched position; and retaining means at the other end of said front holder portion for holding the rear holder portion in the compressed position when the rear holder portion is moved to the compressed position.

2. The ball-point pen according to claim 1, wherein said front holder portion includes a front holder body in the form of a hollow rod, and said refill tip protrudes with said extending part of said concealing means from one end of the front holder body, and said rear holder portion includes a rear holder body in the form of a hollow rod slidably fitted on the other end portion of the front holder body.

3. The ball-point pen according to claim 2, wherein said front holder portion includes a substantially cylindrical mouthpiece removably attached to the one end of the front holder body, a first, end plate member closing the other end of the front holder body, and a cylindrical refill casing disposed in the front holder body, one end portion of the refill casing being inserted in the front holder body into operative relation with said concealing means, and the other end thereof being fixed to the end plate member, and wherein said ball-point pen refill is removably inserted in the refill casing, and the refill tip projects with said extending part of said concealing means from the mouthpiece.

4. The ball-point pen according to claim 3, wherein said rear holder portion includes a second rear end plate member closing one end of the rear holder body and facing the first end plate member.

5. The ball-point pen according to claim 4, wherein said retaining means includes a first engaging portion formed on the first end plate member of the front holder portion, and a second engaging portion formed on the second rear end plate member of the rear holder portion and adapted to engage the first engaging portion when the rear holder portion is moved to the compressed position thereof.

6. The ball-point pen according to claim 5, wherein said first engaging portion includes a projection protruding from the first end plate member toward the second rear end plate member, and said second engaging portion includes a recess formed in the second rear end plate member.

7. The ball-point pen according to claim 4, wherein said retaining means includes a magnet attached to the first end plate member of the front holder portion, and an attraction member fixed to the second rear end plate member of the rear holder portion and adapted to be attracted to the magnet when the rear holder portion is moved to the compressed position thereof.

8. The ball-point pen according to claim 4, wherein said first end plate member of the front holder portion includes a hollow cylindrical portion extending toward the second, rear end plate member of the rear holder portion, and said second rear end plate member includes an insert member extending toward the first end plate member and adapted to be inserted in the cylindrical portion.

9. The ball-point pen according to claim 8, wherein said retaining means includes a magnet attached to the bottom of the cylindrical member, and an attraction member attached to the extended end of the insert member and adapted to be attracted to the magnet when the rear holder portion is moved to the compressed position thereof.

10. The ball-point pen according to claim 4, wherein said concealing means includes a concealing sleeve supported by the mouthpiece, slidably fitted on the refill tip portion of the ball-point pen refill, and adapted to move between a concealing position to conceal the refill tip and a retracted position to expose the refill tip; an urging member for urging the concealing sleeve toward the retracted position; and a push rod supported in the ball-point pen body for axial movement, having two ends capable of engaging the concealing sleeve and the second rear end plate member of the rear holder portion, individually, and adapted to be pressed by the second rear end plate member to push the concealing sleeve to the concealing position thereof when the rear holder portion is moved to the compressed position thereof.

11. The ball-point pen according to claim 2, wherein said front holder portion includes a stopper provided on the outer surface of the other end portion of the front holder body, whereby the rear holder body is prevented from coming off.

12. The ball-point pen according to claim 11, wherein said stopper includes a leaf spring attached to the outer surface of the other end portion of the front holder body and elastically in sliding contact with the inner surface of the rear holder body.

13. The ball-point pen according to claim 1, wherein said concealing means includes a push member movably disposed in the body, for pushing the extending part of said concealing means to a concealing position to conceal the refill tip, when the rear holder portion is moved to the compressed position.

* * * * *